United States Patent [19]

Butler et al.

[11] Patent Number: 4,694,884

[45] Date of Patent: Sep. 22, 1987

[54] MOLTEN METAL CASTING AND FEEDER SLEEVES FOR USE THEREIN

[75] Inventors: David R. Butler, Lichfield; Clifford F. Corbett, Walsall, both of England

[73] Assignee: Foseco International Limited, Birmingham, England

[21] Appl. No.: 845,532

[22] Filed: Mar. 28, 1986

[30] Foreign Application Priority Data

May 17, 1985 [GB] United Kingdom ..... 8512514

[51] Int. Cl.[4] ..... B22C 9/08

[52] U.S. Cl. ..... 164/359; 164/360; 249/105; 249/197

[58] Field of Search ..... 164/47, 122, 137, 359, 164/360, 363; 249/105, 106, 197, 201, 202

[56] References Cited

FOREIGN PATENT DOCUMENTS 1940880 2/1971 Fed. Rep. of Germany ..... 164/359
2907301 9/1980 Fed. Rep. of Germany ..... 164/360
2917520 11/1980 Fed. Rep. of Germany ..... 164/360
8002279 10/1981 Sweden .

*Primary Examiner*—Nicholas P. Godici
*Assistant Examiner*—Richard K. Seidel
*Attorney, Agent, or Firm*—Nixon & Vanderhye

[57] ABSTRACT

Molten metal is cast in a mould having a feeder cavity, which may be defined by a feeder sleeve, whose surface has a plurality of elongate projections or ribs spaced apart around its perimeter, the number and dimensions of the ribs being such that the volume of the feeder cavity is reduced by at least 20% compared to a feeder cavity of generally the same size and shape but without the ribs. Preferably the ribs extend substantially the full length of the inner surface of the feeder sleeve. The sleeve may have for example four ribs whose shape and size is such that the horizontal cross-section of the feeder cavity defined by the sleeve is cruciform. The ribs may be formed of material having an exothermic, an exothermic and heat-insulating, or a heat-insulating composition. The ribs enable a given casting to be fed from a smaller quantity of feeder metal than is usual.

34 Claims, 2 Drawing Figures

MOLTEN METAL CASTING AND FEEDER SLEEVES FOR USE THEREIN

Figure 1:
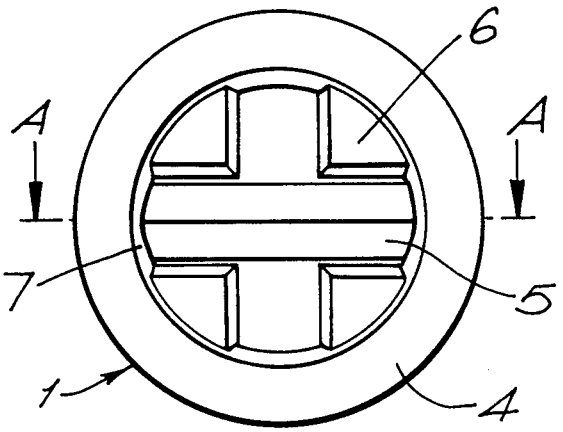

This invention relates to a method of casting molten metal and to feeder sleeves for use therein.

When molten metal is cast into a mould and allowed to solidify the metal shrinks during solidification and its volume is reduced. In order to compensate for this shrinkage and to ensure that sound castings are produced it is usually necessary to emply so-called feeders located above and/or at the side of castings. When the casting solidifies and shrinks molten metal is fed from the feeder(s) into the casting and prevents the formation of shrinkage cavities. In order to improve the feeding effect and to enable the feeder volume to be reduced to a minimum it is common practice to surround the feeder cavity and hence the feeder itself with an exothermic and/or heat-insulating material which retains the feeder metal in the molten state for as long as possible.

The shape of the feeder has also been found to have an effect on the feeder's efficiency. It is generally believed that a spherical feeder should be the most efficient because of its maximum modulus for a given weight of metal, that is that a spherical feeder exhibits the minimum cooling surface area for a given volume of metal and hence minimises the rate of heat loss.

However, in practice, as solidification of metal within a casting attached to a spherical feeder progresses the shape of the residual metal in the feeder alters due to metal being drained from the feeder to the casting, and as the metal in the feeder becomes less spherical in shape the modulus, and hence the feeder efficiency are reduced.

Therefore in practice the efficiency of a spherical feeder tends towards that of a cylindrical shape and although spherical feeders are used they are much less common than cylindrical feeders which have become the generally adopted feeder shape in foundry practice worldwide.

It has now been found that by providing the surface of a feeder caity with protrusions, which occupy part of the cavity volume, and which increase the surface area of the material, which surrounds the cavity, and which comes into contact with the molten metal in the feeder, the rate at which heat is lost from the feeder metal can be reduced, and that when the cavity is surrounded by exothermic material heat produced when the material reacts passes more easily into the feeder metal. As a result solidification of the feeder metal is delayed and this enables a given casting to be fed from a smaller quantity of feeder metal than is usual.

According to the invention there is provided a method of casting molten metal comprising forming a mould having a feeder cavity whose surface has a plurality of elongate projections (hereinafter, for the brevity, called "ribs") spaced apart around its perimeter, the number and dimensions of the ribs being such that the volume of the feeder cavity is reduced by at least 20% compared to a feeder cavity of generally the same size and shape but having no ribs, and casting molten metal into the mould.

The feeder cavity may be defined by a sleeve and the invention also includes for use in the method described above a feeder sleeve whose inner surface has a plurality of ribs spaced apart around its perimeter, the number and dimensions of the ribs being such that the volume of the feeder cavity is reduced by at least 20% compared to the feeder cavity of a sleeve of generally the same size and shape but having no ribs.

The ribs are preferably of the same shape and size and preferably are equally spaced apart.

The ribs preferably extend substantially the full length of the inner surface of the feeder sleeve, and although they may extend along the whole length of the feeder sleeve, if desired they may finish a short distance above the base of the feeder sleeve so as to allow the insertion of the rim of a push fit or tapered breaker core which will facilitate removal of the feeder from the casting. Furthermore, instead of terminating abruptly the ribs may taper at their lower end to meet the feeder sleeve wall so as to give a gradual increase in cross-section.

The shape and size of the internal ribs may be such that the horizontal cross-section of the feeder cavity defined by the sleeve has one of a variety of forms. Preferably the sleeve has four ribs and defines a feeder cavity whose horizontal cross-section is cruciform, for example a cross having four arms whose width is greater than their length, a cross havaing four arms whose width and length are equal, or a cross having four arms whose width is smaller than their length, all leaving open a center portion of the sleeve. The ribs may be for example triangular, square, rectangular or semi-circular in cross-section and the protruding edge of the ribs may be for example pointed, flat or round.

The perimeter of the feeder cavity or of the inner surface of the feeder sleeve from which the ribs protrude may be for example circular or oval. When the perimeter is circular the generally radial extent of the ribs at the point of their greatest protrusion into the feeder cavity is preferably at least 15%, and more preferably from 20–40%, of the maximum feeder cavity diameter or of the maximum inside diameter of the sleeve.

If desired the ribs may be tapered from one end to the other so that the distance which they protrude into the feeder cavity varies.

The outer surface of the feeder sleeve of the invention may have the same contour as the inner surface so that the sleeve has uniform wall thickness, or alternatively the outer surface may be a simpler shape, for example having a circular or oval perimeter.

If desired the inner and/or outer surface of the sleeve may taper from one end to the other. In particular to enable the sleeve to be inserted in a performed feeder cavity in the mould the outer surface of the sleeve may have a negative taper from the bottom of the sleee to the top.

The sleeve may be open at its top end or it may be a so-called blind feeder sleeve which is closed at its top end by a cover, which may be for example flat or hemispherical, and which may be formed integrally with the sleeve or fixed to the sleeve. The cover may have a Williams core formed integrally with or fixed to the underside of the cover in order to ensure that during solidification of the casting atmospheric pressure is exerted on the feeder metal so as to improve the feeding effect.

The ribs may be formed of material having an exothermic composition, a composition which is both exothermic and heat-insulating, or of a heat-insulating composition, and the composition of the rib material may be the same as or different from that of the remainder of the sleeve. Ribs made from an exothermic composition or from a composition which is both exothermic and heat-insulating are preferred.

The method and feeder sleeve of the invention may be used for producing a variety of metals, but are particularly suitable for producing castings in grey iron or spheroidal graphite iron, and steel castings.

When using the method and feeder sleeve of the invention the volume of the feeder cavity for a particular casting can be reduced by up to 50% of the feeder cavity volume needed when the feeder is of the conventional cylindrical shape. This means that the quantity of molten metal needed to produce a particular casting is reduced and that more castings can be produced from each melt.

Figure 2:
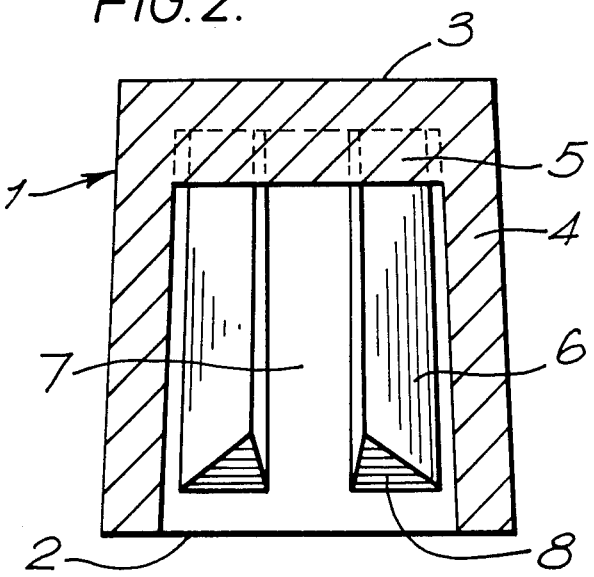

The invention is illustrated by way of example with reference to the accompanying drawings in which:

FIG. 1 is a bottom plan view of a feeder sleeve according to the invention and FIG. 2 is a vertical cross-section of the sleeve of FIG. 1 along the line A—A.

Referring to the drawings a feeder sleeve 1 having a central vertical axis is open at its bottom end 2 and closed at its top end by a flat cover 3 formed integrally with a sidewall 4 of the sleeve. A Williams core 5 in the form of a wedge is formed integrally with the inner surface of the cover 3 and extends across a diameter of the sleeve 1 over the full inner surface of the cover 3.

Four ribs 6 formed integrally with the inner surface 7 of the sleeve 1 are equally spaced apart around the perimeter of the inner surface and extend from the top end of the sleeve to within 10 mm of the bottom end 2. Each rib is tapered at 45° at its lower end 8 to meet the inner surface 7 of the sleeve. The sleeve 1 tapers inwardly from its bottom end 2 to the cover 3.

A number of feeder sleeves were produced in exothermic and het-insulating material, without ribs, with ribs as shown in the drawings, and also with ribs which extended to the bottom end of the sleeve instead of tapering to end a distance above the bottom end.

The basic sleeves had the following dimensions:

Bottom outside diameter: 94.0 mm
Bottom inside diameter: 70.5 mm
Top outside diameter: 89.5 mm
Top inside diameter: 65.5 mm
Outside height: 100.5 mm
Inside height: 88.0 mm The Williams wedge had a width of 20 mm at its top, a width of 3 mm at its bottom and a height of 20 mm.

The ribs were formed from the same material as the basic sleeves. In some cases the radial protrusion of the ribs was 20 mm and in other cases the radial protrusion was 25 mm.

Some of the sleeves were used in cold set resin bonded sanded moulds to produce plate castings in spheroidal graphite iron and some to produce cube castings in steel. In each case conventional cylindrical sleeves of the same dimensions were also tested for comparison purposes.

Details of the test and the results obtained are shown in the table below, demonstrating that it is possible to obtain a significant improvement in casting yield by the use of feeder sleeves according to the invention.

| TEST NO | DESCRIPTION OF INTERNAL RIBS | CASTING TYPE | FEEDER SLEEVE INTERNAL VOLUME ($cm^3$) | CASTING VOLUME ($cm^3$) | RATIO-FEEDER TO CASTING VOLUME (%) | CASTING SOUND-NESS | FEEDER WEIGHT (kg) |
|---|---|---|---|---|---|---|---|
| 1 | NONE | STEEL CUBE OF SIDE 115 MM | 300 | 1520 | 19.7 | SOUND | 2.28 |
| 2 | 4 RIBS EACH 25 MM THICK ENDING 10 MM ABOVE SLEEVE BASE | STEEL CUBE OF SIDE 115 MM | 160 | 1520 | 10.5 | SOUND | 1.22 |
| 3 | NONE | SG IRON PLATE 290 × 290 × 30 MM | 300 | 2523 | 11.9 | SOUND | 2.35 |
| 4 | 4 RIBS EACH 20 MM THICK EXTENDING TO BASE OF SLEEVE | SG IRON PLATE 290 × 290 × 30 MM | 150 | 2523 | 5.9 | SOUND | 1.18 |

We claim:

1. A feeder sleeve for use in casting molten metal in which metal is cast into a mould and having a feeder cavity defined by the feeder sleeve, the feeder sleeve having an inner surface and a plurality of discrete ribs extending inwardly from said surface and spaced one from the other around its perimeter to define a feeder cavity with an open center portion, said ribs extending substantially the full length of the inner surface and terminating at their lower ends in faces which taper to meet the inner surface, and the number and dimensions of said ribs being such that the volume of the feeder cavity is reduced by at least 20% compared to the volume of the feeder cavity of a sleeve of generally the same internal size and shape but having no ribs.

2. A feeder sleeve according to claim 1, wherein said feeder sleeve has a bottom, the lower tapered faces of said ribs being spaced from said sleeve bottom.

3. A feeder sleeve according to claim 1, wherein said sleeve has a bottom, said tapered lower faces tapering inwardly from said inner surface generally in a direction away from said sleeve bottom.

4. A feeder sleeve according to claim 1, wherein said feeder sleeve has a central axis and said ribs extend inwardly toward said central axis but terminate short thereof, the lower faces of said ribs tapering upwardly toward said central axis and in a direction generally away from said sleeve bottom.

5. A feeder sleeve according to claim 1, wherein at least a pair of said ribs lie on opposite sides of said sleeve and extend inwardly toward and are spaced from one another.

6. A feeder sleeve according to claim 1 wherein all ribs have the same shape and size.

7. A feeder sleeve according to claim 1 wherein the ribs are equally spaced apart.

8. A feeder sleeve according to claim 1 wherein the sleeve has four ribs and defines a feeder cavity whose horizontal cross-section is cruciform.

9. A feeder sleeve according to claim 8 wherein the horizontal cross-section of the feeder cavity is a cross having four arms whose width is greater than their length.

10. A feeder sleeve according to claim 8 wherein the horizontal cross-section of the feeder cavity is a cross having four arms whose width and length are equal.

11. A feeder sleeve according to claim 8 wherein the horizontal cross-section of the feeder cavity is a cross having four arms whose width is smaller than their length.

12. A feeder sleeve according to claim 1 wherein the ribs are triangular, square, rectangular or semi-circular in cross-section.

13. A feeder sleeve according to claim 1 wherein the perimeter of the inner surface of the sleeve from which the ribs protrude is circular.

14. A feeder sleeve according to claim 13 wherein the generally radial extent of the ribs at the point of their greatest protrusion into the feeder cavity is at least 15% of the maximum feeder cavity diameter.

15. A feeder sleeve according to claim 14 wherein the radial extent of the ribs at the point of their greatest protrusion into the feeder cavity is 20–40% of the maximum feeder cavity diameter.

16. A feeder sleeve according to claim 1 wherein the perimeter of the inner surface of the sleeve from which the ribs protrude is oval.

17. A feeder sleeve according to claim 1 wherein the ribs are tapered from one end to the other end.

18. A feeder sleeve according to claim 1 wherein the outer surface of the sleeve has the same contour as the inner surface.

19. A feeder sleeve according to claim 1 wherein the outer surface of the sleeve is circular or oval.

20. A feeder sleeve according to claim 1 wherein the inner and/or the outer surface of the sleeve is tapered from one end of the sleeve to the other end.

21. A feeder sleeve according to claim 20 wherein the outer surface of the sleeve has a negative taper from the bottom of the sleeve to the top.

22. A feeder sleeve according to claim 20 wherein the inner surface of the sleeve has a negative taper from the bottom of the sleeve to the top.

23. A feeder sleeve according to claim 1 wherein the sleeve is open at its top end.

24. A feeder sleeve according to claim 1 wherein the sleeve is closed at its top end by a cover.

25. A feeder sleeve according to claim 24 wherein the cover is flat or hemi-spherical.

26. A feeder sleeve according to claim 24 wherein the cover is formed integrally with the sleeve.

27. A feeder sleeve according to claim 4 wherein the cover has a Williams Core formed integrally with or fixed to the underside of the cover.

28. A feeder sleeve according to claim 1 wherein the ribs are formed of material having an exothermic composition, an exothermic and heat-insulating composition, or a heat-insulating composition.

29. A feeder sleeve according to claim 28 wherein the remainder of the sleeve is formed of the same material as the ribs.

30. A feeder sleeve for use in casting molten metal in which metal is cast into a mould and having a feeder cavity defined by the feeder sleeve, the feeder sleeve having a top, a bottom, a central vertical axis, and an inner surface having a plurality of inwardly extending discrete ribs spaced apart one from the other about said surface, said ribs extending substantially the full length of the inner surface and terminating at their lower ends in faces which taper in a direction away from said sleeve bottom and toward said vertical axis, said ribs extending inwardly toward said central axis and terminating short thereof.

31. A feeder sleeve according to claim 30, wherein the lower tapered faces of said ribs are spaced from said sleeve bottom.

32. A feeder sleeve according to claim 31, wherein the lower tapered faces of said ribs taper from said inner surface toward said central axis.

33. A feeder sleeve according to claim 30, wherein each of said ribs has a pair of side faces joined one to the other to form an elongated sharp edge extending substantially the full length thereof.

34. A feeder sleeve according to claim 30, wherein the lower tapered faces of said ribs are spaced from said sleeve bottom and taper from said inner surface toward said vertical axis, said ribs defining a feeder cavity with an open center portion containing said vertical axis, and the number and dimensions of said ribs being such that the volume of the feeder cavity is reduced by at least 20% compared to the volume of the feeder cavity of a sleeve of generally the same internal size and shape but having no ribs.

* * * * *